US008348694B2

(12) United States Patent
Kah

(10) Patent No.: US 8,348,694 B2
(45) Date of Patent: Jan. 8, 2013

(54) ELECTRONIC DEVICE WITH CARD CONNECTOR

(75) Inventor: Young-il Kah, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 578 days.

(21) Appl. No.: 12/534,894

(22) Filed: Aug. 4, 2009

(65) Prior Publication Data

US 2010/0061050 A1 Mar. 11, 2010

(30) Foreign Application Priority Data

Sep. 10, 2008 (KR) ..... 10-2008-0089293

(51) Int. Cl.
*H01R 13/64* (2006.01)

(52) U.S. Cl. ..... 439/374; 439/76.1; 439/926

(58) Field of Classification Search ..... 439/374, 439/377, 138, 64, 76.1, 79, 926
See application file for complete search history.

(56) References Cited

U.S. PATENT DOCUMENTS 5,035,633 A * 7/1991 Kobayashi et al. ..... 439/140
5,398,154 A * 3/1995 Perkins et al. ..... 361/212
6,122,175 A * 9/2000 Shieh ..... 361/737
6,332,784 B1 * 12/2001 Oliphant et al. ..... 439/76.1
6,482,030 B1 * 11/2002 Kuo ..... 439/541.5

* cited by examiner

*Primary Examiner* — Tulsidas C Patel
*Assistant Examiner* — Travis Chambers
(74) *Attorney, Agent, or Firm* — Sughrue Mion, PLLC

(57) ABSTRACT

Provided is an electronic device into which a card having a connection terminal is inserted. The electronic device includes a circuit board; a card connector which is mounted at a circumference of the circuit board and includes a signal terminal; and a card guiding unit which guides the card during insertion of the card to couple the connection terminal and the signal terminal.

20 Claims, 9 Drawing Sheets

ELECTRONIC DEVICE WITH CARD CONNECTOR

CROSS-REFERENCE TO RELATED APPLICATION

This application claims priority from Korean Patent Application No. 10-2008-0089293, filed on Sep. 10, 2008, in the Korean Intellectual Property Office, the disclosure of which is incorporated herein by reference.

BACKGROUND OF THE INVENTION

1. Field of the Invention

Apparatuses consistent with the present invention relate to an electronic device, and more particularly, to an electronic device into which a card is inserted.

2. Description of the Related Art

Recently, the development and use of electronic devices into which a card is inserted and which provide additional functions is on the rise. For example, if a card which is purchased is inserted into a television (TV) that is set to block a certain channel, a user may view that certain channel.

The card is electrically connected with a circuit board in the electronic device. However, it is difficult to reduce the size of the circuit board due to a configuration necessary for connection with the card.

SUMMARY OF THE INVENTION

The present invention provides an electronic device into which a card including a connection terminal is inserted, the electronic device including: a circuit board; a card connector which is mounted at a circumference of the circuit board and includes a signal terminal; and a card guiding unit which guides the card during insertion of the card to couple the connection terminal and the signal terminal.

A portion of the card connector may protrude beyond a circumference of the circuit board.

An end part of the signal terminal may protrude beyond the circumference of the circuit board.

The card connector and the card guiding unit may be spaced apart from one another.

The electronic device may further include a case which accommodates therein the circuit board and the card connector, wherein the card guiding unit is disposed in the case.

The card guiding unit may be coupled to the case.

The card guiding unit may be formed in the case as a single body.

The case may include an insertion slot into which the card is inserted.

The case may also include a first case part which is substantially parallel to the circuit board, a second case part which is substantially parallel to the circuit board and is spaced apart from the first case part in a direction perpendicular to the circuit board, and a third part which is not parallel to the circuit board and connects the first case part and the second case part, and the insertion slot is formed in the third part.

The case may further include a guiding door that is movable by the card being inserted, between a closed position in which the guiding door covers the insertion slot and an open position in which the guiding door does not cover the insertion slot.

The electronic device may further include a display panel which is disposed on a front side of the circuit board, wherein the first case part is disposed between the display panel and the second case part, and the card guiding unit is protrudingly formed on the second case part.

The electronic device may further include a display panel, and a front case and a rear case which surround the display panel, wherein the circuit board is interposed between the display panel and the rear case.

The card guiding unit may include: a pair of guiding bars which face each other and define a space therebetween into which the card is inserted, and each of the guiding bars includes a guiding groove to accommodate therein a lateral end part of the card.

The signal terminal may include a plurality of signal pins aligned with one another along a direction transverse to an insertion direction of the card, the card connector may further include a pair of card contacting parts which are each provided adjacent to an outer signal pin, and each of the card contacting parts includes a curved surface that contacts and guides the card.

Further, the present invention provides an electronic device into which a card having a connection terminal is inserted, the electronic device including: a display panel; a front case which has an opening that exposes a display region of the display panel; a rear case which is coupled to the front case and accommodates the display panel together with the front case, the rear case having an insertion slot to insert the card thereinto; a circuit board which is interposed between the display panel and the rear case; a card connector which has a signal terminal to be coupled to the connection terminal and is mounted on the circuit board so that an end part of the signal terminal protrudes toward the outside of the circuit board; and a card guiding unit which is disposed between the insertion slot and the card connector and guides the card during insertion of the card to couple the connection terminal to the signal terminal.

The end part of the signal terminal may protrude beyond a circumference of the circuit board.

The card guiding unit may be formed in the rear case as a single body.

The rear case may include a first case part and a second case part which are substantially parallel to the circuit board and are spaced apart from one another in a direction transverse to the circuit board; a third case part which connects the first case part and the second case part; and the third case part includes an insertion slot through which the card is insertable.

The card guiding unit may include a pair of guiding bars facing each other and defines a space therebetween into which the card is inserted, and each of the guiding bars includes a guiding groove to accommodate therein a lateral end part of the card. Furthermore, the present invention provides an electronic device into which a card including a connection terminal is inserted, the electronic device including: a circuit board having a circumference; a card connector which is mounted at a circumference of the circuit board, the card connector including a signal terminal to be coupled to the connection terminal, wherein a part of the card connector extends outside of the circumference of the circuit board.

The signal terminal may extend outside of the circumference of the circuit board.

The card connector may include a guide surface that is angled toward the signal terminal to guide the connection terminal of the card toward the signal terminal.

The guide surface of the card connector may include a convex curve.

The signal terminal may be disposed on an outside edge of the card connector, and the outside edge of the card connector may be aligned with an edge of the circuit board that defines part of the circumference of the circuit board.

The electronic device may further include a card guiding unit which guides the card during insertion of the card to couple the connection terminal and the signal terminal.

BRIEF DESCRIPTION OF THE DRAWINGS

The above and/or other aspects of the present invention will become apparent and more readily appreciated from the following description of the exemplary embodiments, taken in conjunction with the accompanying drawings of which.

DETAILED DESCRIPTION OF EXEMPLARY EMBODIMENT

Hereinafter, exemplary embodiments of the present invention will be described with reference to accompanying drawings, wherein like numerals refer to like elements and repetitive descriptions will be avoided as necessary.

In exemplary embodiments of the present invention, a television will be described as an example of an electronic device, but the present invention is not limited thereto. Alternatively, the present invention is applicable to all electronic devices, e.g., a portable computer, into which a card is inserted to be electrically connected with a circuit board.

An exemplary embodiment of the present invention will be described with reference to FIGS. 1 to 6.

Figure 1:
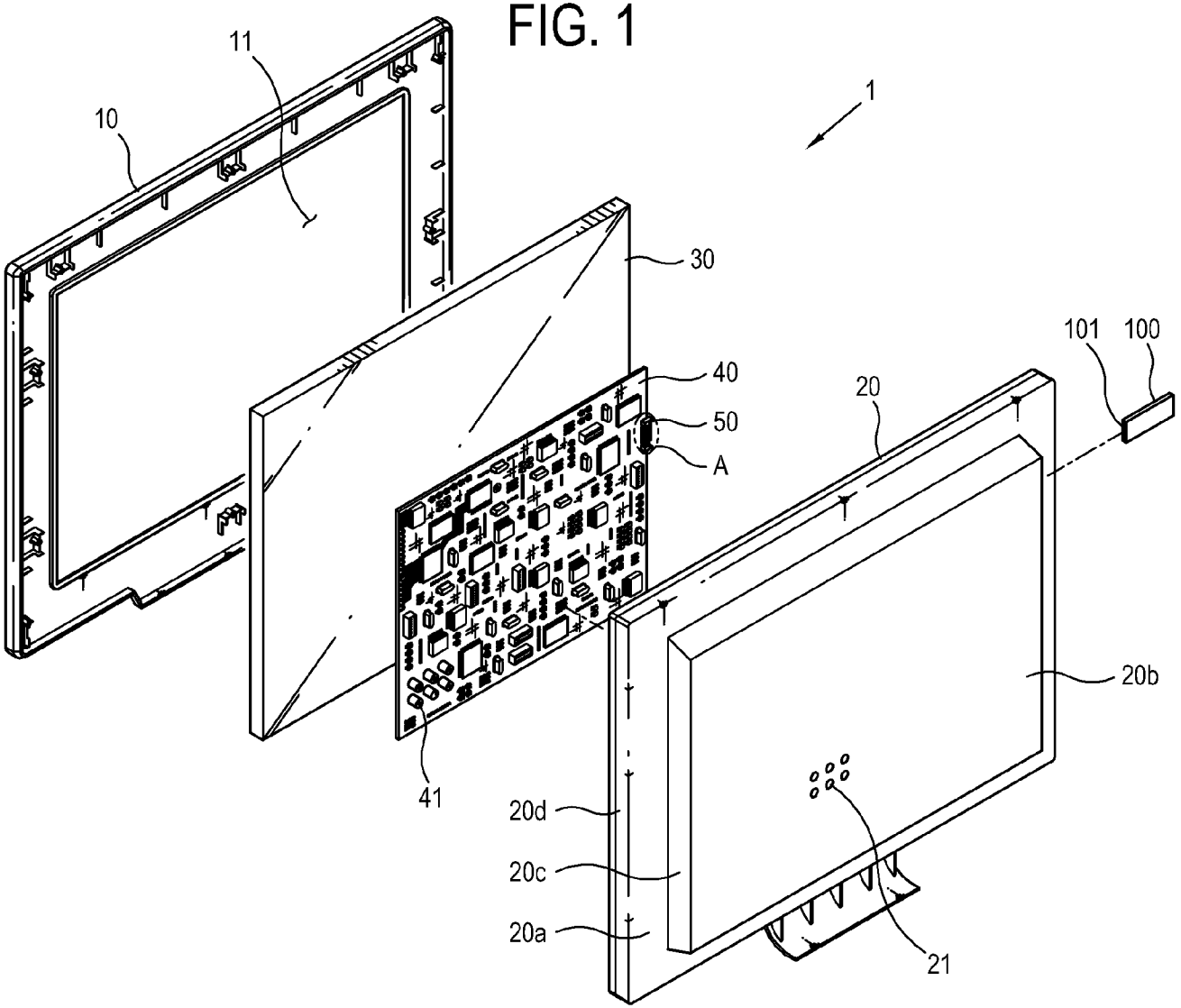
FIG. 1 is an exploded perspective view of an electronic device according to an exemplary embodiment of the present invention.

FIG. 1 illustrates a TV 1 from a rear side. The TV 1 includes a front case 10, a rear case 20, a display panel 30, a circuit board 40 and a card connector 50. The TV 1 may further include a support unit (not shown) which contacts a wall or surface. The support unit may be integrally formed in the cases 10 and 20. FIG. 1 also illustrates a card 100 which is inserted into the TV 1. A connection terminal 101 which is depressed from an external surface of the card 100 is formed in a side of the card 100.

The front case 10 is coupled to the rear case 20, accommodating the display panel 30, the circuit board 40 and the card connector 50 therein.

An opening 11 is formed in the front case 10 and a front surface of the display panel 30 is exposed to the outside through the opening 11.

The rear case 20 includes a first case part 20*a* and a second case part 20*b* which are spaced apart from one another in a direction transverse to the plane along which the circuit board extends. The first and second case parts 20*a* and 20*b* are disposed to be substantially parallel to the circuit board 40, and the second case part 20*b* is farther from the display panel 30 than the first case part 20*a*. A third case part 20*c* connects the first case part 20*a* and the second case part 20*b*. The third case part 20*c* is inclined between the first case part 20*a* and the second case part 20*b* and is not parallel to the circuit board 40. In another exemplary embodiment, the third case part 20*c* may be perpendicular to the circuit board 40. A fourth case part 20*d* extends bent or perpendicularly from an end part of the first case part 20*a*, and couples the front case 10 and the rear case 20.

An exposing hole 21 is formed in the second case part 20*b* so that a jack 41 which is formed in the circuit board 40 is exposed to the outside through the exposing hole 21. The jack 41 may be connected to the outside to receive an audio signal and/or a video signal. A card guiding unit 24 (refer to FIG. 5) is provided on an internal side of the second case part 20*b* facing the circuit board 40. The card guiding unit 24 guides the card 100 to the card connector 50 when the card 100 is inserted into the TV 1. The detailed configuration of the card guiding unit 24 will be described later.

Figure 2:
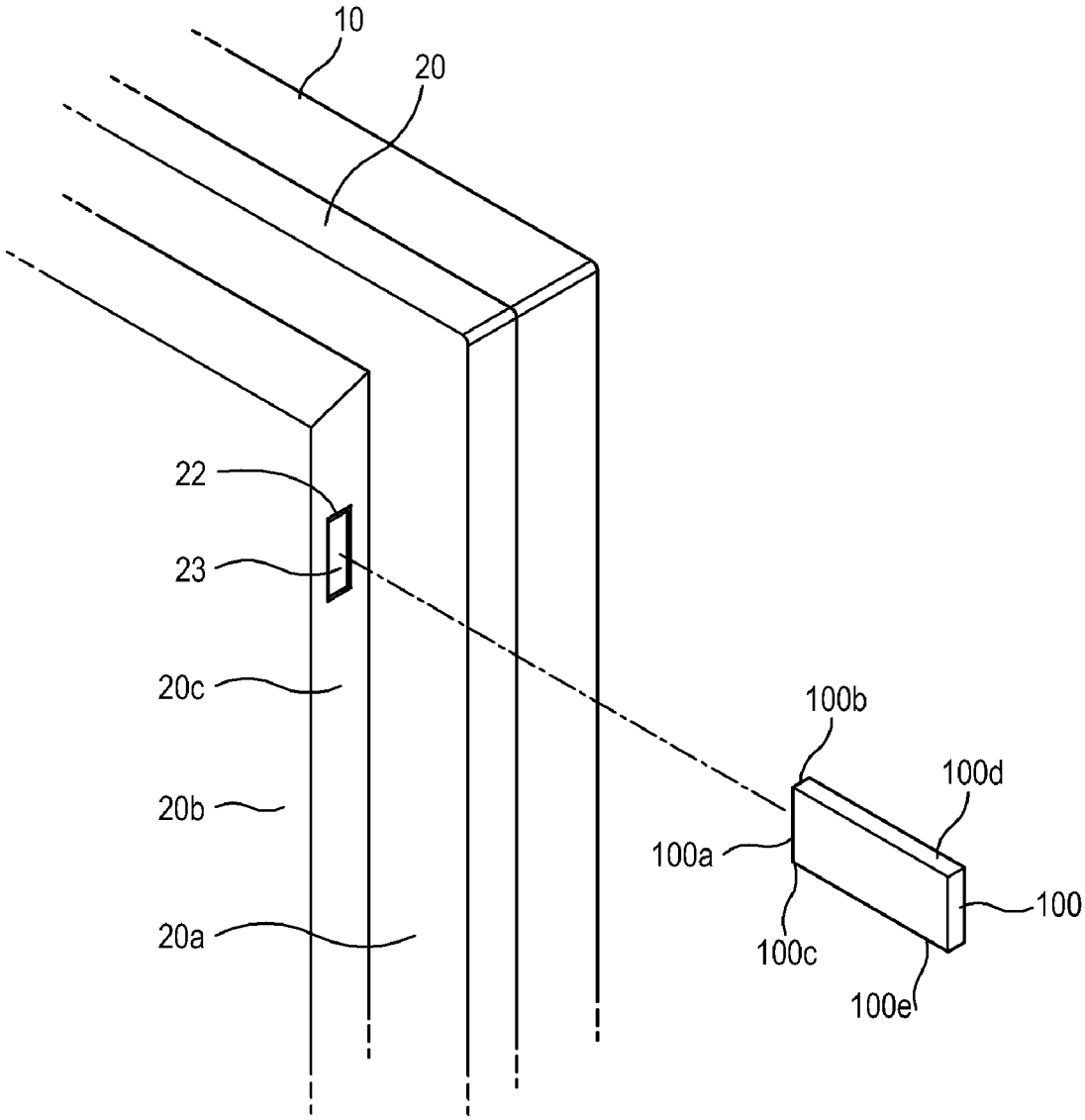
FIG. 2 illustrates a process of inserting a card into the electronic device according to the exemplary embodiment of the present invention.

An insertion slot 22 (refer to FIG. 3) is formed in the third case part 20*c* and is covered by a guiding door 23 (refer to FIG. 2). The card 100 is inserted into the TV 1 through the insertion slot 22 which is elongated in a vertical direction. If the card 100 is not inserted into the insertion slot 22, the guiding door 23 covers the insertion slot 22 to prevent impurities such as dust from being introduced to the TV 1. If the card 100 is inserted into the insertion slot 22, the guiding door 23 contacts the card 100 and moves to uncover the insertion slot 22.

The card 100 is inserted into the insertion slot 22, guided by the card guiding unit 24 and coupled to the card connector 50. The card 100 may decode an encoded broadcasting or video on demand (VOD) signal or make wireless Internet available.

The display panel 30 has a flat shape and forms a screen. The display panel 30 may include but is not limited to a plasma display panel, a liquid crystal display (LCD) panel or an organic light emitting diode (OLED) panel. If the display panel 30 includes the LCD panel, it also includes a backlight unit.

The circuit board 40 may be smaller than the display panel 30 and has a panel shape. Several electronic components including the jack 41 and the card connector 50 are mounted in the circuit board 40. The circuit board 40 receives an image signal from an external source, processes the received image signal and supplies the processed image signal to the display panel 30.

The card connector 50 electrically connects the card 100 and the circuit board 40 and is mounted at a circumference of the circuit board 40. The card connector 50 is coupled to the card 100 which is inserted and guided by the card guiding unit 24. The detailed configuration of the card connector 50 will be described later.

Figure 3:
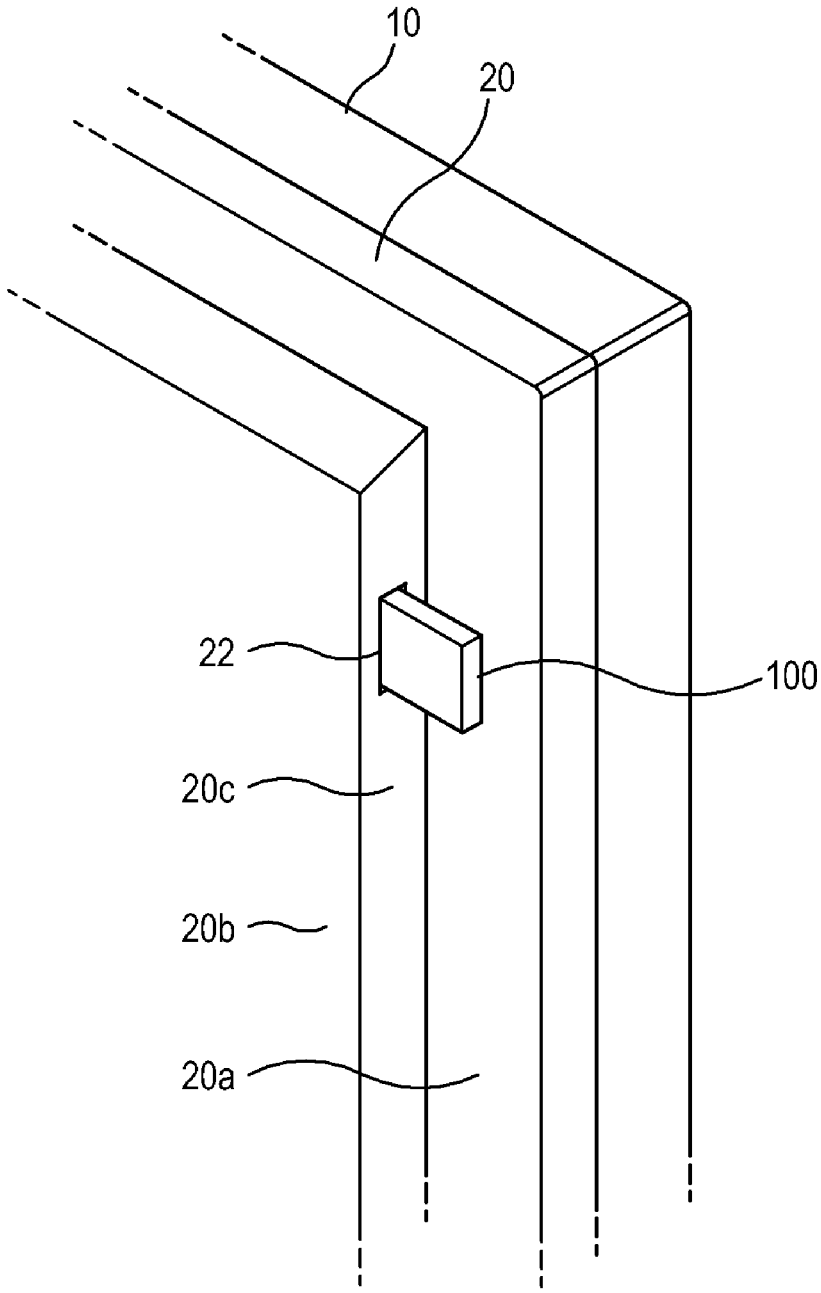
FIG. 3 illustrates a state of the card inserted in the electronic device according to the exemplary embodiment of the present invention.

FIGS. 2 and 3 illustrate a process of inserting the card 100 into the TV 1.

As shown in FIG. 2, the card 100 is inserted into the insertion slot 22 while a lengthwise direction of the card 100 is positioned transversely so that the connection terminal 101 faces the insertion slot 22. The guiding door 23 is folded inward as a result of contact with the card 100 allowing the card 100 to be inserted into the insertion slot 22.

The card 100 is generally shaped like a rectangle and is substantially flat and elongated. An insertion end part 100*a* having the connection terminal 101 is inserted first, lateral end parts 100*d* and 100*e* are guided by the card guiding unit 24 in an insertion process, and insertion edges 100*b* and 100*c* contact and are guided by a card contacting part 54 (refer to FIG. 4) and are coupled to the card connector 50 in a last part of the insertion process.

FIG. 3 illustrates the card 100 fully inserted into the insertion slot 22 completely. Still, a part of the card 100 is exposed to the outside of the TV 1 even though the card 100 is fully inserted. The guiding door 23 is in an inwardly-folded state. Most of the insertion slot 22 is covered by the card 100 so as to prohibit impurities such as dust from being introduced into the TV 1.

Figure 4:
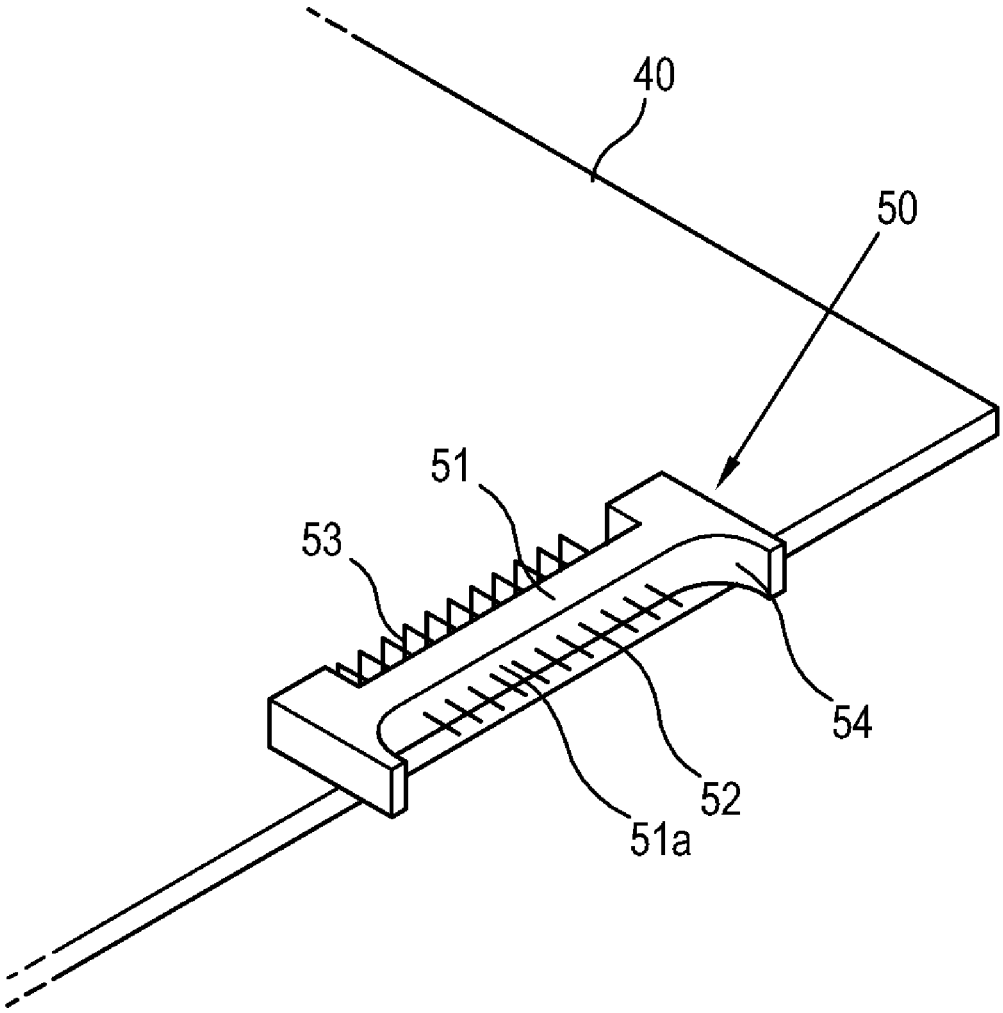
FIG. 4 is an extended perspective view of a part A in FIG. 1.

The card connector 50 will be described with reference to FIG. 4.

The card connector 50 is mounted on the circumference of the circuit board 40 and a part of the card connector 50 extends beyond the circumference of the circuit board 40, i.e., outside of the circuit board 40. In other words, part of the card connector 50 extends past an edge of the circuit board 40.

The card connector 50 includes a connector main body 51 which is adhered to the circuit board 40, a signal terminal which in the exemplary embodiments includes at least one signal pin 52 which is coupled to the connection terminal 101 of the card 100 when the card 100 is inserted into the insertion slot 22, a substrate connecting pin 53 which is connected with the circuit board 40 and the card contacting part 54 which guides the card 100 to be inserted into the insertion slot 22.

The connector main body 51 is elongated along a lateral side of the circuit board 40 and is mounted on the circuit board 40 so that a mounting surface 51*a* from which the signal pin 52 protrudes corresponds to a circumferential end part of the circuit board 40 substantially. In other words, the mounting surface 51*a* and the lateral side of the circuit board 40 are aligned with one another in a direction perpendicular to the circuit board 40. The connector main body 51 may be adhered to the circuit board 40 by soldering, etc.

The signal pin 52 protrudes from the connector main body 51 to the outside of the circuit board 40. The signal pin 52 is arranged to correspond to the connection terminal 101 of the card 100. In the exemplary embodiment, the inserted card 100, while in a fully inserted position, is disposed such that it does not overlap the circuit board 40 because the signal pin 52 protrudes toward the outside of the circuit board 40 beyond the lateral edge of the circuit board 40.

The substrate connecting pin 53 is connected to the circuit board 40 and electrically connects the signal pin 52 and the circuit board 40. Each signal pin 52 and corresponding substrate connecting pin 53 may be formed as a single body.

The card contacting part 54 extends from opposite end parts of the card main body 51 and protrudes toward the outside of the circuit board 40. A part of the card contacting part 54 facing the signal pin 52, i.e., a part which contacts the card 100, has a convexly curved surface. Consequently, if the card 100 is not correctly inserted, the insertion edges 100*b* and 100*c* of the card 100 contact the card contacting part 54 and are guided to the correct position.

Circuit components are not mounted in a part of the circuit board 40 which overlaps the inserted card 100. Thus, the size of the circuit board 40 will increase the more the card 100 overlaps the circuit board 40. However, in the exemplary embodiment, the card connector 50 is disposed at the circumference of the circuit board 40 so that the card 100 does not overlap the circuit board 40. Thus, it is not necessary to consider the overlapping region between the circuit board 40 and the card 100. Further, a circuit component may be mounted in an area adjacent to the card connector 50 to thereby improve use efficiency of the circuit board 40.

The card guiding unit 24 will be described with reference to FIG. 5.

Figure 5:
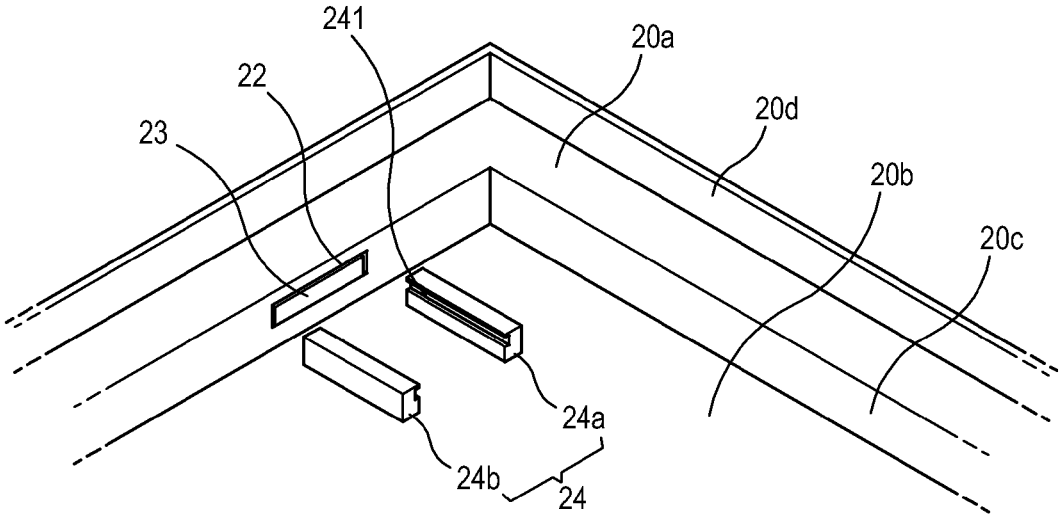
FIG. 5 is an internal perspective view of a rear case of the electronic device according to the exemplary embodiment of the present invention.

FIG. 5 illustrates an internal side of the rear case 20, i.e. a surface which faces the circuit board 40. The guiding door 23 is formed in the third case part 20*c* while the card guiding unit 24 is formed on the second case part 20*b* that is adjacent to the guiding door 23. The card guiding unit 24 includes the first card guiding unit 24*a* and the second card guiding unit 24*b*. As the first and second card guiding units 24*a* and 24*b* have the same configuration, the description of the first card guiding unit 24*a* below also applies to the second card guiding unit 24*b*.

The first card guiding unit 24*a* and the second card guiding unit 24*b* are disposed parallel to each other. The card 100 is disposed between and guided by the first card guiding unit 24*a* and the second card guiding unit 24*b*.

The first card guiding unit 24*a* is elongated and substantially perpendicular to the guiding door 23. The first card guiding unit 24*a* is formed on the second case part 20*b* as a single body. That is, the rear case 20 which includes the card guiding unit 24 is integrally formed by an injection method.

A guiding groove 241 which has a U-shape is formed in a surface of the first card guiding unit 24*a* facing the second card guiding unit 24*b*. The guiding groove 241 is formed to have substantially the same height or thickness as that of the insertion slot 22.

If the card 100 is inserted into the insertion slot 22, one of the lateral end parts 100*d* and 100*e* of the card 100 is slidingly accommodated in the guiding groove 241 of the first card guiding unit 24*a* while the other one is slidingly accommodated in the guiding groove 241 of the second card guiding unit 24*b*.

Figure 6:
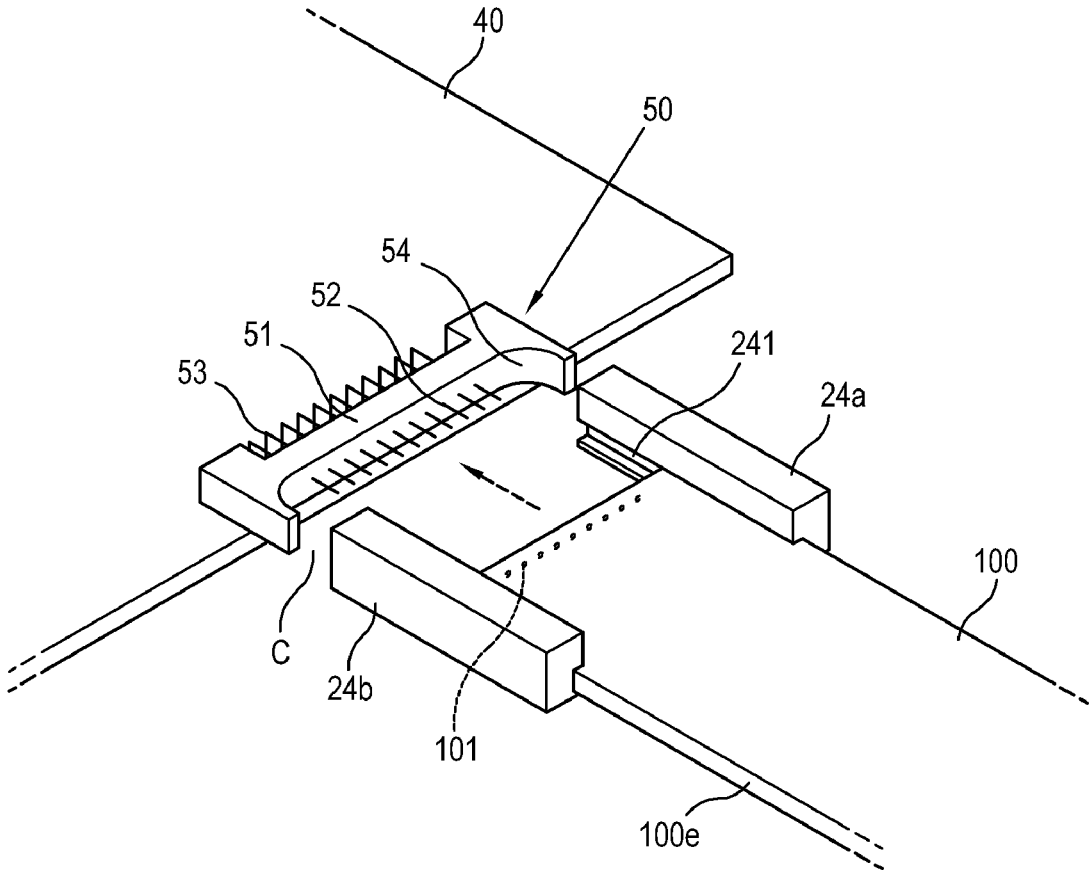
FIG. 6 illustrates a relation between a card connector and a card guiding unit of the electronic device according to the exemplary embodiment of the present invention.
Figure 7:
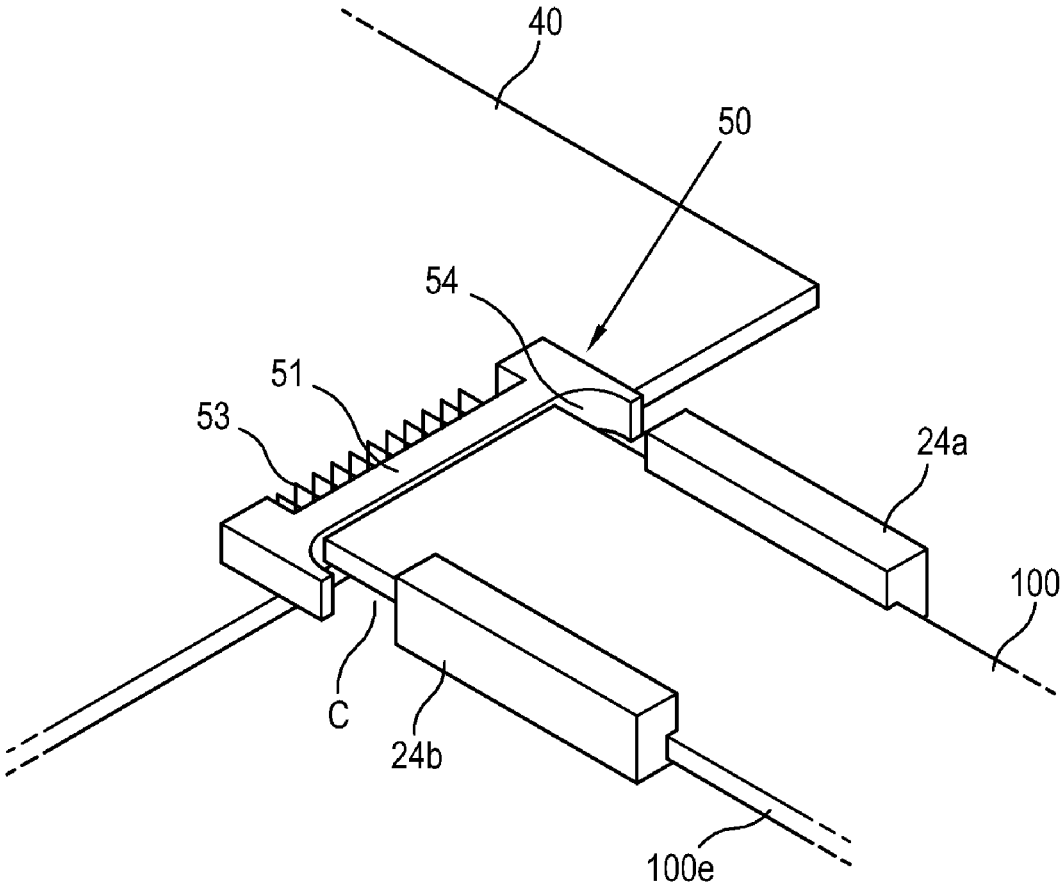
FIG. 7 illustrates a coupling state of a card and the card connector of the electronic device according to the exemplary embodiment of the present invention.

The connection of the card 100 and the circuit board 40 will be described with reference to FIGS. 6 and 7. FIGS. 6 and 7 focus on the card connector 50 and the card guiding unit 24, but do not illustrate the second case part 20*b*.

For the insertion of the card 100, the guiding door 23 is folded inward and the card 100 is inserted into the TV 1 through the insertion slot 22. If the insertion end part 100*a* of the card 100 passes through the insertion slot 22, the opposite lateral end parts 100*d* and 100*e* of the card 100 are accommodated in the guiding groove 241 of the card guiding unit 24.

If a user pushes the card 100 further, the opposite lateral end parts 100*d* and 100*e* of the card 100 are slidingly guided by the card guiding unit 24 and progress toward the card connector 50. The connection terminal 101 which is formed in the insertion end part 100*a* of the card 100 is stably coupled to the signal pin 52 of the card connector 50 by the guide of the card guiding unit 24.

As the card connector 50 and the card guiding unit 24 are not formed as a single body, there may be a space C therebetween. Thus, the guide of the card 100 may be unstable in the space C. In this case, the insertion edges 100*b* and 100*c* of the card 100 contact the card contacting part 54 and find the correct position.

The connection between the card 100 and the card connector 50 is maintained stably, which results from the connection between the connection terminal 101 and the signal pin 52 and the support of the card 100 by the card guiding unit 24. Thus, the card 100 is stably inserted into the insertion slot 22 of the TV 1, and removed only by a user's intention. A user may grab the end part (refer to FIG. 3) of the card 100 exposed to the outside of the TV 1 and pull the card 100 out of the insertion slot 22. In another exemplary embodiment, the card guiding unit 24 may further include a configuration for fixing a lateral side of the card 100 with an elastic force.

According to the exemplary embodiment, electrical connection between the card 100 and the circuit board 40 may be stable while the use efficiency of the circuit board 40 may increase as the card 100 does not overlap the circuit board 40. The increased use efficiency of the circuit board 40 enables a smaller circuit board 40. Accordingly, manufacturing costs, packing and logistics costs are reduced and the TV 1 may be slimmer.

The foregoing exemplary embodiment may vary. A part of the card 100, e.g., only 20% or smaller of the overall dimension of the card 100 may overlap the circuit board 40 to thereby improve the use efficiency of the circuit board 40. Also, the card connector 50 may be changed to perform some functions of the card guiding unit 24.

Figure 8:
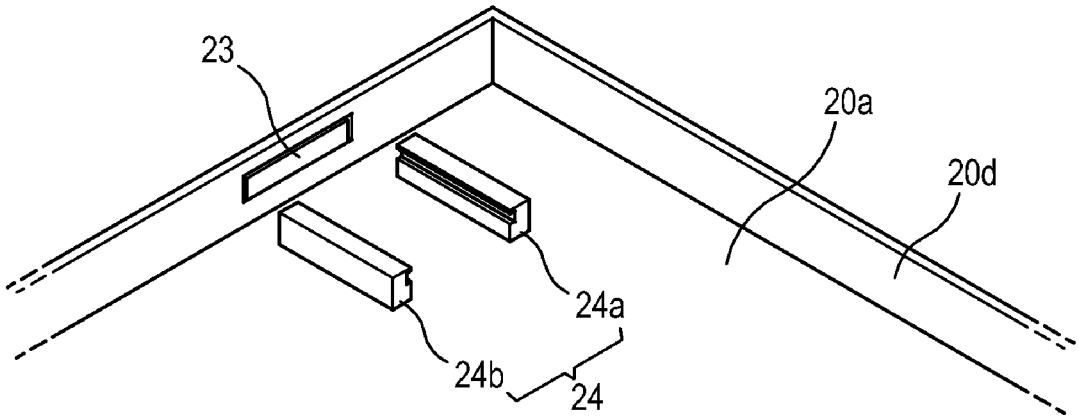
FIG. 8 is an internal perspective view of a rear case of an electronic device according to another exemplary embodiment of the present invention.

Another exemplary embodiment of the present invention will be described with reference to FIG. 8.

A rear case 20 according to the another exemplary embodiment has a single height (i.e., does not comprise multiple parts that are spaced from one another), and a guiding door 23 is formed in a fourth case part 20*d*. In another exemplary embodiment, the guiding door 23 may be elongated transversely. In this case, a card 100 is inserted into a TV 1 with its lengthwise direction being vertical.

Another exemplary embodiment of the present invention will be described with reference to FIG. 9.

Figure 9:
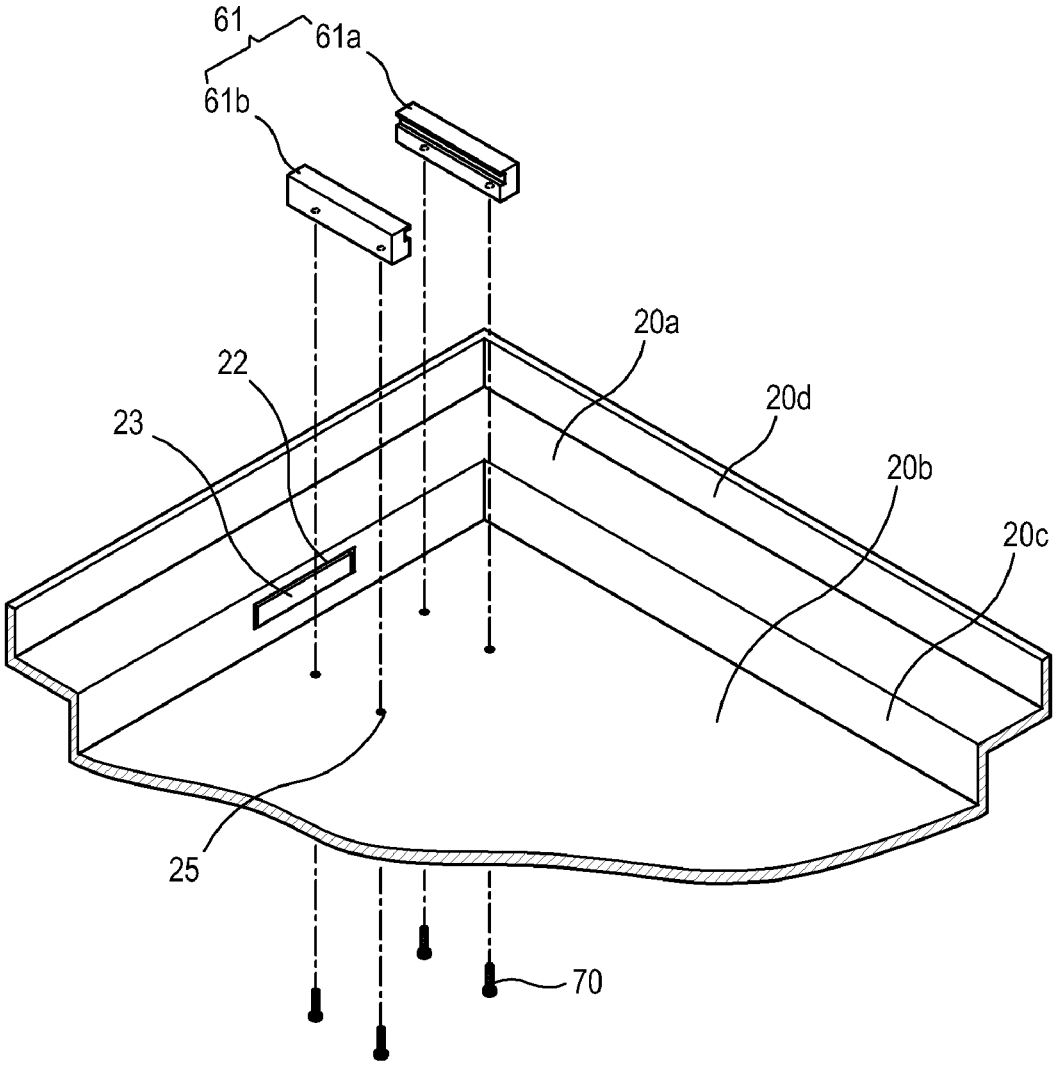
FIG. 9 illustrates a relation between a rear case and a card guiding unit of an electronic device according to another exemplary embodiment of the present invention.

Referring to FIG. 9, a card guiding unit 61 is additionally provided, and coupled to a rear case 20. The card guiding unit 61 includes a first card guiding unit 61*a* and a second card guiding unit 61*b* which are disposed parallel to each other. The card guiding unit 61 is adhered to a second case part 20*b* through a coupling hole 25 formed in the second case part 20*b* and through a screw 70. A female screw thread which is not shown is formed in a lower surface of the card guiding unit 61 to be coupled to the screw 70. The method of coupling the card guiding unit 61 which is separately provided and attached to the rear case 20 is not limited to the screw connection method.

Although a few exemplary embodiments of the present invention have been shown and described, it will be appreciated by those skilled in the art that changes may be made in these exemplary embodiments without departing from the principles and spirit of the invention, the scope of which is defined in the appended claims and their equivalents.

What is claimed is:

1. An electronic device into which a card comprising a connection terminal is inserted, the electronic device comprising:

a circuit board;

a card connector which is mounted at a circumference of the circuit board and comprises a signal terminal and a pair of card contacting parts each adjacent to the signal terminal to contact front edges of the card; and a card guiding unit which guides lateral end parts of the card during insertion of the card, wherein the lateral end parts of the card are first guided by the card guiding unit and the front edges of the card are contacted and are second guided by the card contacting parts, thereby the connection terminal is coupled to the signal terminal, and wherein surface of the card contacting parts which contacts the front edges of the card comprises an inwardly curved surface which guides the card.

2. The electronic device according to claim 1, wherein the pair of card contacting parts includes a guide surface that is angled toward the signal terminal to guide the connection terminal of the card toward the signal terminal.

3. The electronic device according to claim 1, wherein a portion of the card connector protrudes beyond the circumference of the circuit board.

4. The electronic device according to claim 3, wherein an end part of the signal terminal protrudes beyond the circumference of the circuit board.

5. The electronic device according to claim 3, wherein the card connector and the card guiding unit are spaced apart from one another.

6. The electronic device according to claim 5, further comprising a case which accommodates therein the circuit board and the card connector, wherein the card guiding unit is disposed in the case.

7. The electronic device according to claim 6, wherein the card guiding unit is coupled to the case.

8. The electronic device according to claim 6, wherein the card guiding unit is formed in the case as a single body.

9. The electronic device according to claim 6, wherein the case further comprises an insertion slot through which the card is insertable and a guiding door movable by the card being inserted between a closed position in which the guiding door covers the insertion slot and an open position in which the guiding door does not cover the insertion slot.

10. An electronic device into which a card comprising a connection terminal is inserted, the electronic device comprising:

a circuit board;

a card connector which is mounted at a circumference of the circuit board and comprises a signal terminal and a pair of card contacting parts each adjacent to the signal terminal to contact front edges of the card; and a card guiding unit which guides lateral end parts of the card during insertion of the card, wherein the lateral end parts of the card are first guided by the card guiding unit and the front edges of the card are contacted and are second guided by the card contacting parts, thereby the connection terminal is coupled to the signal terminal, and wherein at least a part of the card guiding unit is formed out of the circuit board.

11. An electronic device into which a card comprising a connection terminal is inserted, the electronic device comprising:

a circuit board;

a card connector which is mounted at a circumference of the circuit board and comprises a signal terminal and a pair of card contacting parts each adjacent to the signal terminal to contact front edges of the card; and a card guiding unit which guides lateral end parts of the card during insertion of the card, wherein the lateral end parts of the card are first guided by the card guiding unit and the front edges of the card are contacted and are second guided by the card contacting parts, thereby the connection terminal is coupled to the signal terminal, and wherein the card guiding unit comprises a pair of guiding bars which face each other and define a space therebetween into which the card is inserted, and each of the guiding bars comprises a guiding groove to accommodate therein a lateral end part of the card.

12. An electronic device into which a card comprising a connection terminal is inserted, the electronic device comprising:

a circuit board;

a card connector which is mounted at a circumference of the circuit board and comprises a signal terminal and a pair of card contacting parts each adjacent to the signal terminal to contact front edges of the card; and a card guiding unit which guides lateral end parts of the card during insertion of the card, wherein the lateral end parts of the card are first guided by the card guiding unit and the front edges of the card are contacted and are second guided by the card contacting parts, thereby the connection terminal is coupled to the signal terminal, and wherein the signal terminal comprises a plurality of signal pins aligned with one another along a direction transverse to an insertion direction of the card, and each of the card contacting parts comprises a curved surface that contacts and guides the card.

13. An electronic device into which a card comprising a connection terminal is inserted, the electronic device comprising:

a display panel;

a front case which comprises an opening that exposes a display region of the display panel;

a rear case which is coupled to the front case, and accommodates the display panel together with the front case, the rear case comprising an insertion slot to insert the card thereinto;

a circuit board which is interposed between the display panel and the rear case;

a card connector which comprises a signal terminal and a pair of card contacting parts each adjacent to the signal terminal to contact front edges of the card, the card connector being mounted on the circuit board so that an end part of the signal terminal protrudes toward the outside of the circuit board; and a card guiding unit disposed between the insertion slot and the card connector and guides lateral end parts of the card during insertion of the card, wherein the lateral end parts of the card are first guided by the card guiding unit and the front edges of the card are contacted and are second guided by the card contacting parts, thereby the connection terminal is coupled to the signal terminal.

14. The electronic device according to claim 13, wherein the card guiding unit is formed in the rear case as a single body.

15. An electronic device into which a card comprising a connection terminal is inserted, the electronic device comprising:

a circuit board;

a card connector which is mounted on the circuit board and comprises a signal terminal and a pair of card contacting parts each adjacent to the signal terminal to contact front edges of the card; and a card guiding unit which guides lateral end parts of the card during insertion of the card and is spaced apart from the card connector, wherein the lateral end parts of the card are first guided by the card guiding unit and the front edges of the card are contacted and are second guided by the card contacting parts, thereby the connection terminal is coupled to the signal terminal, and wherein a surface of the card contacting parts which contacts the front edges of the card comprises an inwardly curved surface which guides the card.

16. The electronic device according to claim 15, wherein the card connector is mounted at a circumference of the circuit board.

17. The electronic device according to claim 15, wherein at least a part of the card guiding unit is formed out of the circuit board.

18. An electronic device into which a card comprising a connection terminal is inserted, the electronic device comprising:

a circuit board;

a card connector which is mounted on the circuit board and comprises a signal terminal and a pair of card contacting parts each adjacent to the signal terminal to contact front edges of the card; and a card guiding unit which guides lateral end parts of the card during insertion of the card wherein at least a part of the card guiding unit is formed out of the circuit board, wherein the lateral end parts of the card are first guided by the card guiding unit and the front edges of the card are contacted and are second guided by the card contacting parts, thereby the connection terminal is coupled to the signal terminal, and wherein a surface of the card contacting parts which contacts the front edges of the card comprises an inwardly curved surface which guides the card.

19. The electronic device according to claim 18, wherein at least a part of the card guiding unit is spaced apart from the card connector.

20. The electronic device according to claim 18, wherein the card connector is mounted at a circumference of the circuit board.

* * * * *